United States Patent [19]

Karpisek

[11] Patent Number: 4,653,658

[45] Date of Patent: Mar. 31, 1987

[54] LIQUID CONTAINERS

[76] Inventor: Ladislav S. Karpisek, 86 Woodfield Boulevarde, Caringbah, New South Wales, 2229, Australia

[21] Appl. No.: 849,892

[22] Filed: Apr. 9, 1986

[51] Int. Cl.[4] ..... B65D 6/24

[52] U.S. Cl. ..... 217/43 A; 217/12; 217/4; 220/4 F

[58] Field of Search ..... 217/4, 12, 43 A, 43 R; 220/4 F

[56] References Cited

U.S. PATENT DOCUMENTS

| | | | |
|---|---|---|---|
| 3,563,578 | 2/1971 | Meller | 220/4 F |
| 3,705,663 | 12/1972 | Schubert | 217/43 A |
| 3,760,970 | 9/1973 | Lutz | 220/4 F |
| 3,888,379 | 6/1975 | Folberth | 217/43 A |
| 4,503,973 | 3/1985 | Andersson | 217/43 A |

FOREIGN PATENT DOCUMENTS

| | | | |
|---|---|---|---|
| 514757 | 7/1955 | Canada | 217/43 A |
| 1191106 | 10/1959 | France | 217/43 A |
| 1282830 | 12/1961 | France | 217/43 A |

*Primary Examiner*—George E. Lowrance
*Attorney, Agent, or Firm*—Anthony A. O'Brien

[57] ABSTRACT

An enclosure comprising four interconnected sides, two opposite sides being coupling sides and the other sides being doors. A channel shaped coupler secured to each side with a channel leg extending under a bottom edge of the side and spaced therefrom to provide a slot to receive an edge of a floor panel for said enclosure. Cleats on the channels on the coupling members to engage the battens of a pallet thereby the mount the enclosure to a pallet.

7 Claims, 6 Drawing Figures

LIQUID CONTAINERS

This invention relates to containers of the type comprised of four interconnected sides mounted on a pallet over which there is a floor panel within the sides. One use of such a container is for the transportation of liquids. To enable this to be done a plastic film bag is placed in the container and then filled with the liquid. A lid is placed on the container and the filled closed container can be transported to a desired location.

It has been found that in transport and in handling there is a degree of flexing of the pallet battens and this results in movement between the floor panel lying thereon and the sides of the container. This flexing and movement is accentuated by the allowed manufacturing tolerances for the container members and the variations that occur in the thicknesses of the timber used for pallet battens. The flexing and movements have resulted in the development of pinch points where the sides and floor panel meet. The pinch points can result in holes in the plastic bag with attendant loss of liquid from the bag.

In an effort to eliminate the pinch points flexible lipped seals have been placed around the peripheral edge of the floor panel with the lips bearing firmly against the adjacent sides of the container. This has not been totally successful. This invention provides a modification to the above arrangement wherein means are provided to tie the side and bottom panels of the container together so that their spacial relationship will remain substantially constant even when the container is subjected to forces which would otherwise cause relative movement therebetween and pinch point creating separation thereof.

Figure 1:
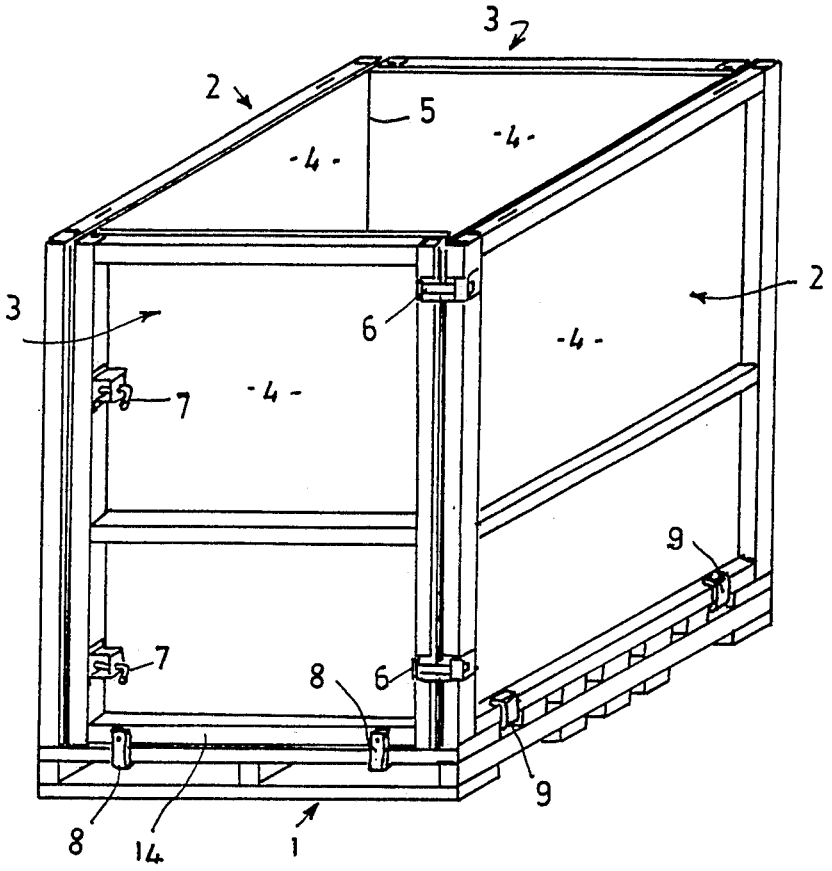
Figure 2:
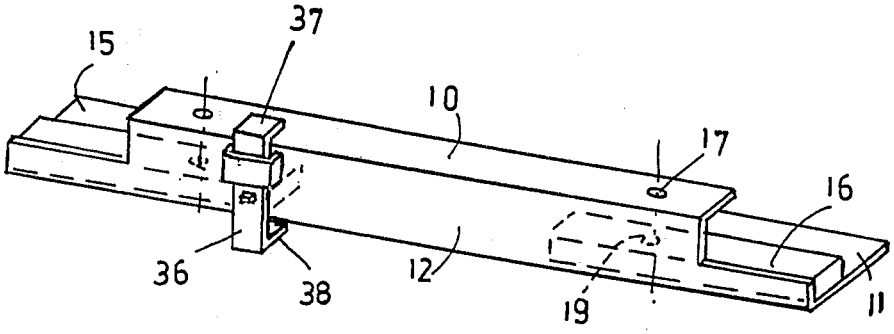
Figure 3:
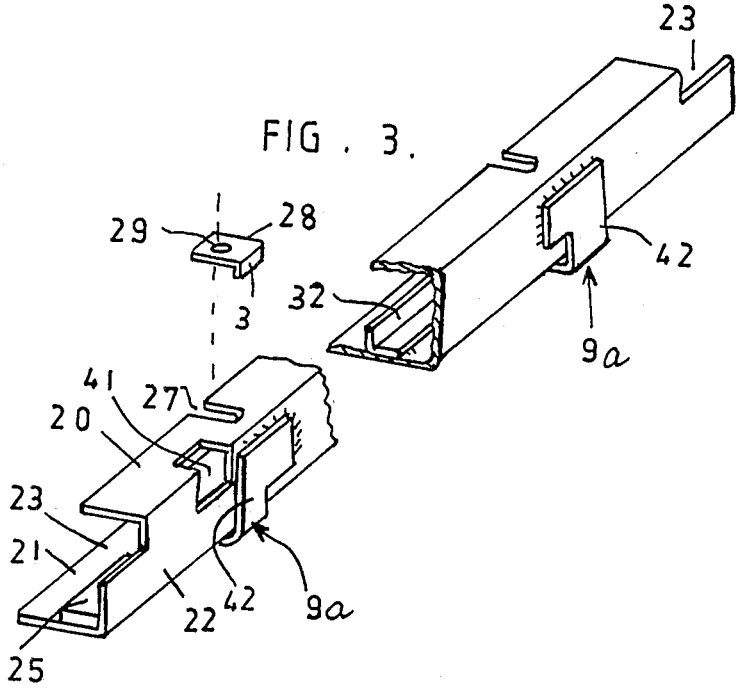
Figure 4:
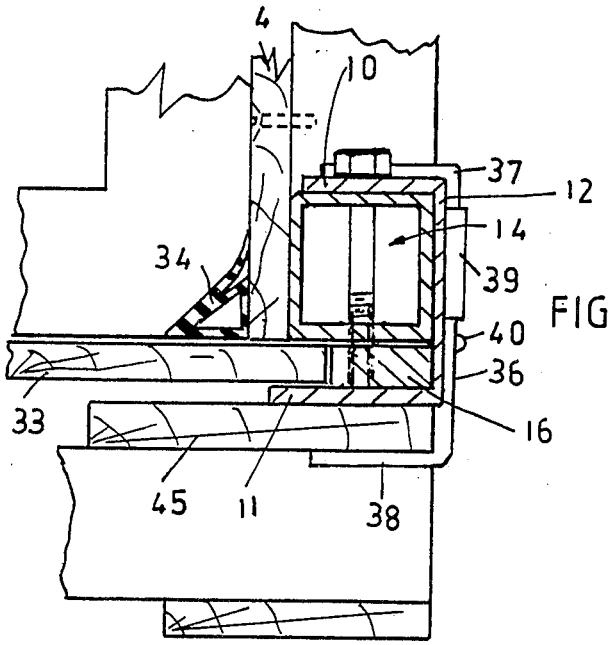
Figure 5:
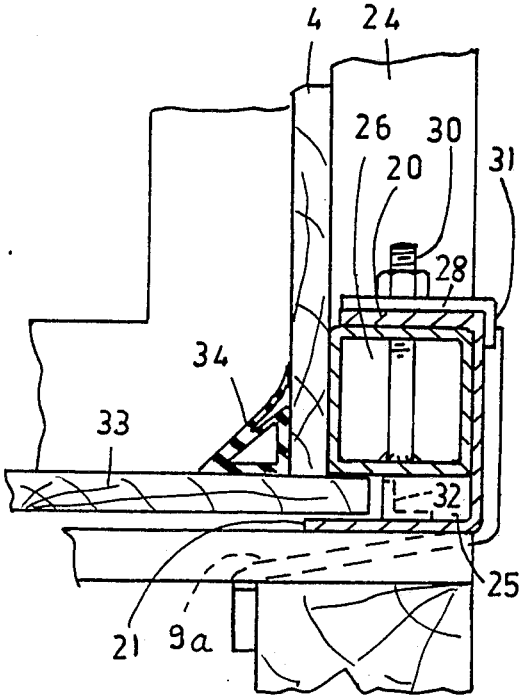
Figure 6:
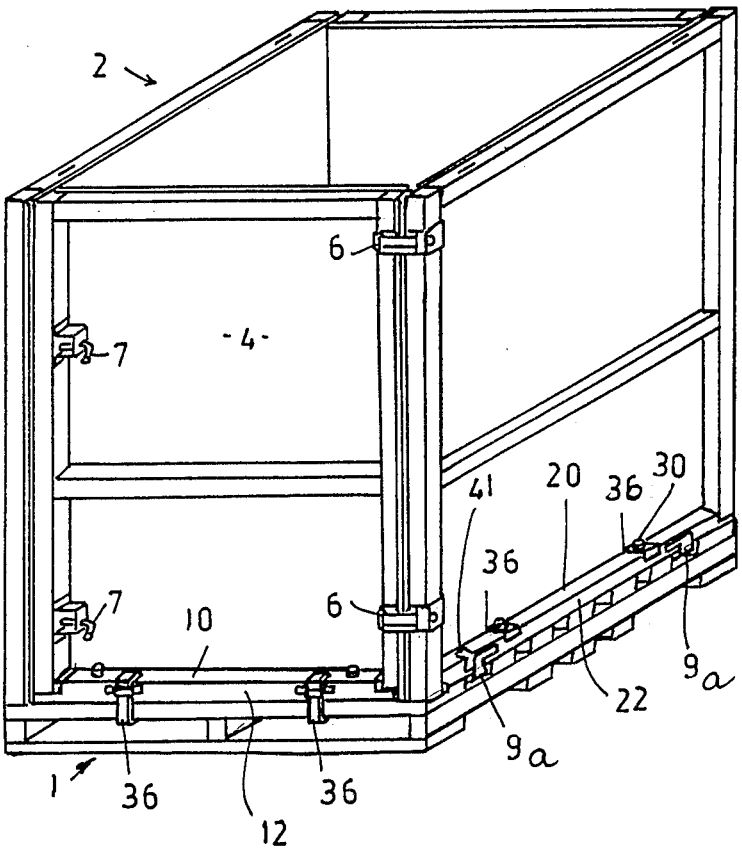

A presently preferred embodiment of the invention will now be described with reference to the accompanying drawings in which:

FIG. 1 is a perspective view of a container as now used for the transport of liquids in a plastic liner bag, FIG. 2 is a perspective view of a coupler of the type used for the door panels of the container as shown in FIG. 1 to adapt it to the concept of the present invention, FIG. 3 is a perspective view of a coupler of the type used for the panels which lock to the pallet in a container of the type shown in FIG. 1 and which adapt such a container to the concept of the present invention, FIG. 4 is a fragmentary end view showing the coupler of FIG. 2 in service, FIG. 5 is a fragmentary end view showing the coupler of FIG. 3 in services and FIG. 6 is a view similar to FIG. 1 showing a container according to the present invention.

FIG. 1 shows a typical arrangement for a container of the known type. There is a pallet 1 on which there is mounted two panel pairs each comprised of a locking panel 2 and a door panel 3. The panels 2 and 3 are comprised of a rectangular frame with a central cross-bar made from square tube and there is a panel of smooth faced material, such as plywood, 4 fixed to the inner faces of the frames.

The panels 4 abut very tightly at the corners 5 as a result of the form of the hinges 6 connecting each panel 2 to its associated panel 3. The door panel 3 of each panel pair is interlocked by bolts 7 to the panel 2 of the other panel pair. The panels 2 are interconnected with the pallet by means of cleats 9 which may be of hooked form (as shown in Australian Pat. No. 503317. The door has hooked lugs 8 to engage under the end batten of the pallet.

The floor panel 33 is not shown in FIG. 1. It lies on top of the top pallet battens and its four edges lie adjacent and within the four panels 4. There must be clearance between the cleats 9 and the lugs 8 and the pallet battens to allow the interconnection of the members. There is also a working tolerance allowed in the thickness of the battens during manufacture. The two clearances can add up to a substantial amount of freedom for movement between the sides 2 and 3 and the floor panel, as referred to above.

As an example, when a liquid filled container as just described is being transported on a truck if there was to be a sharp up-lift or down-drop of the truck body the weight of the liquid in the plastic bag acting on the floor panel would allow the sides of the container to move up and down relative to the floor panel as the truck jolted up and down. Clearances so created, even momentarily, can allow the entry into the clearance of a pocket of liquid filled plastic. When the sides settle down to the rest position in engagement with the tops of the pallet top battens the pocket of liquid containing plastic is "pinched" with the possible result that it will rupture with a consequent leakage of liquid.

In order to overcome this couplers are provided. In FIG. 2 the coupler for a door side 3 is illustrated. It comprises a channel with an upper flange 10 and a wider bottom flange 11 joined by a back 12. The channel is slid over the lower bar 14 of the door side 3 so the cutouts 15 in the bar will pass around the lugs 8. The width of the upper flange 10 is such that it is no wider than the width of the lower bar 14 but the wider lower flange will extend internally beyond the lower bar 14. It is also to be noted that the bar 14 fits between the underside of the flange 10 and the upper faces of the plates 16, which are substantially the same thickness as the floor panel. The front edges of the plates 16 also serve to position the adjacent edge of the floor panel which, in the proposed arrangement, is larger than the area defined by the panels 4 whereas in the known arrangement it is no larger than the area defined by the panels 4.

The coupler is held in place by bolts passing through the holes 17 in the top flange 10 and holes in the bar 14 into threaded holes 19 in the plates 16.

The coupler for the locking panel 2 comprises a channel with upper flange 20, bottom wider flange 21 and back 22. There are cutouts 23 to allow the mounting bar top flange to extend under the end posts 24 of the side 2 and there are plates 25 on which the lower ends of the posts 24 bear. The mounting of the coupler on the bottom rail 26 is by means of slots 27 in the flange 20 allowing the coupler to be slid laterally onto the rail 26 so the slots 27 pass onto threaded studs 30 welded to the rail 26. It is by means of the studs 30 that the cleats 9 (see FIG. 1) are normally secured to the rail 26. It follows that as the cleat studs 30 are used to secure the coupler the cleats must be held in another manner. In the illustrated arrangement the cleats 9*a* are of a modified form and are welded to the bar.

To prevent the coupler from sliding laterally and disengaging from the studs angled members 28 with hole 29 therethrough are provided. When mounted on the studs 30 the leg 31 of the angled members 28 extend down over the back 22 of the coupler, see FIG. 4.

Welded to the inner face of the bottom flange 21 of the coupler there is an angle member 32 which, with the plates 25, position the peripheral edge of the floor panel of the container. This is illustrated clearly in FIG. 4 where the floor panel 33 is seen to pass under the lining panel 4 of the container side 2. The portion of the floor panel 33 adjacent its edge overlies and rests upon the inner face of the bottom flange 21 and is laterally located by the plates 25 and the angle member 32. The number 34 indicates a flexible lipped sealing member which is fixed to the floor panel 33 and bears tightly against the inner face of the lining panel 4. It will be seen that in the proposed arrangement the relationship between the bottom edge of the lining panel 4 and the floor panel 33 is an overlying one and is fixed by the couplers thereby preventing the relative movement therebetween movement that was previously possible between the sides 2 and 3 and the floor panel 33. Any slight movement that might occur between the sides and the floor panel, due to manufacturing tolerances for the various components, is so small that the plastic of the liner bag cannot enter thereinto.

The edge of the floor panel 33 adjacent the door side 3 is housed in the same manner between the flange 11 of the coupler of FIG. 2 and the underface of the bottom rail 14 of the door side 3. For the floor panel 33 to be mounted in the proposed manner it is made larger than the internal size of the area defined by the panels 4 whereas with the previous known arrangement it was no bigger than that area.

FIGS. 2 and 4 illustrate a variation of the lug 8 illustrated in FIG. 1. For convenience only one example of the variation is illustrated in FIG. 2. The FIG. 1 lug 8 is replaced by a bar 36 with an upper inturned leg 37 and a lower inturned leg 38 to engage under the front pallet batten 45 when the door side 3 is in the closed position. In this way the door side 3 is anchored to the pallet batten 45 to complement the cleat anchorage between the locking side 2 and the pallet. The bar 36 can move up and down under a saddle 39 with its up travel limited by a stop member 40.

Another aspect is the provision of a notch 41 in the coupler of FIG. 3 at the junction of the top flange 20 and the back 22. This notch accomodates a retainer plate used to prevent lateral cleat releasing movement of the locking panel relative to the pallet. Such a retainer plate can be a screw-on attachment but is preferably a swivel mounted member that can be located alongside the cleat leg 42 so that they together take up substantially the whole of the space between two battens and so prevent the lateral cleat releasing movement referred to above. Such an arrangement is shown in Australian Pat. No. 538444.

I claim:

1. An enclosure to mount on a pallet comprised of bearers joined by upper and lower battens, said enclosure comprising two like sections each of two parts, each part comprises a frame with smooth surfaced cladding on its inner face, each frame comprising two posts with at least an upper and a lower rail joining the posts; in each section one post of one part is hingedly connected to a post of the other part and the other posts of the parts of the section are provided with complementary locking means whereby two like sections can be interconnected to form a substantially rectangular enclosure; elongated cleat means coupled to the bottom rails of corresponding first parts of said sections to provide free ends which are hooked for respective engagement under the upper pallet battens at opposite ends of the pallet, a coupler on each part of said sections, each coupler comprising a channel with a first channel leg overlying and fixed to the bottom rail of its associated part and a second channel leg extending below the bottom rail to which it is fixed and spaced therefrom by a predetermined distance to provide a slot of width substantially equal to but not less than the thickness of a floor panel for said enclosure and stop means in the channels to limit the passage of a floor panel into said slots and at least two elongated cleats mounted at first ends to each of the couplers on the second parts of said sections and spaced apart so second free ends thereof can pass between upper battens on a pallet.

2. An enclosure as claimed in claim 1 wherein at least one of the the cleats on the bottom rails of the second parts of said sections has a free end which is hooked to engage under a top batten of a pallet.

3. An enclosure as claimed in claim 1 wherein the cleats on the bottom rails of the second parts of said sections have free ends which are hooked to engage under different top battens of a pallet.

4. An enclosure as claimed in claim 1 wherein the couplers on the second parts of said sections include notches in the edges of the first channel legs to receive bolts on the associated bottom rails and the bolts are retained in the notches by retainers comprising a plate with a hole therein to pass over said bolts and a lug which when the retainers are clamped in position over the coupler channel first legs by nuts on said bolts with the bolts received in the notches will engage over the corner of the channel where the channel first leg joins the base of the channel.

5. An enclosure as claimed in claim 1 wherein each cleat means comprises a bar slidably mounted in a sleeve on the associated bottom rail and a hooked upper end to engage over the associated bottom rail.

6. An enclosure as claimed in claim 1 in combination with a rectangular enclosure floor which is engaged by its edges in the slots provided by all four couplers of the enclosure.

7. An enclosure as claimed in claim 6 wherein the floor has a substantially continuous resiliently deformable upstanding element mounted thereon adjacent its periphery to abut against the cladding of the enclosure parts.

* * * * *